US008827409B2

(12) United States Patent
Nakamura

(10) Patent No.: US 8,827,409 B2
(45) Date of Patent: Sep. 9, 2014

(54) RECORDING APPARATUS

(71) Applicant: Seiko Epson Corporation, Tokyo (JP)

(72) Inventor: Tomonori Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/015,342

(22) Filed: Aug. 30, 2013

(65) Prior Publication Data

US 2014/0063109 A1 Mar. 6, 2014

(30) Foreign Application Priority Data

Aug. 31, 2012 (JP) ..... 2012-191458

(51) Int. Cl.

| | |
|---|---|
| ***B41J 29/38*** | (2006.01) |
| ***B41J 25/308*** | (2006.01) |
| ***B41J 2/01*** | (2006.01) |
| ***B41J 13/00*** | (2006.01) |

(52) U.S. Cl.

CPC ..... *B41J 13/0009* (2013.01); *B41J 25/308* (2013.01); *B41J 25/3082* (2013.01)

USPC ..... 347/16; 347/8; 347/104

(58) Field of Classification Search

CPC .. B41J 13/0009; B41J 25/308; B41J 25/3082; G03F 7/70775

USPC ..... 347/8, 9, 14, 16, 19, 37, 104

See application file for complete search history.

(56) References Cited

U.S. PATENT DOCUMENTS

| | | | | |
|---|---|---|---|---|
| 5,541,626 | A * | 7/1996 | Hiramatsu et al. | 347/8 |
| 5,757,389 | A | 5/1998 | Schwede et al. | |
| 2010/0039473 | A1 | 2/2010 | Terada | |
| 2012/0218328 | A1 | 8/2012 | Hattori et al. | |

FOREIGN PATENT DOCUMENTS

| | | | |
|---|---|---|---|
| EP | 0566540 | A2 | 10/1993 |
| JP | 2002-096527 | A | 4/2002 |
| JP | 2005-349751 | A | 12/2005 |
| WO | 99/21722 | A2 | 5/1999 |

OTHER PUBLICATIONS

The extended European Search Report for European Application No. 13182433.6 mailed Nov. 20, 2013.

* cited by examiner

*Primary Examiner* — Jannelle M Lebron
(74) *Attorney, Agent, or Firm* — Global IP Counselors, LLP

(57) ABSTRACT

It is provided with an apparatus main body that has a medium feed mechanism feeding a recording medium along a feed route, a printing section that has an inkjet head, which performs printing on the recording medium, and has a movable and adjustable configuration in a separate direction with respect to the feed route in response to a thickness of recording mediums, and a medium detection section that detects a lifting on the recording medium from the feed route by detection light emitted along the surface of the recording medium, which is feeding. The medium detection section is attached in the printing section side.

10 Claims, 7 Drawing Sheets

RECORDING APPARATUS

CROSS-REFERENCE TO RELATED APPLICATIONS

This application claims priority to Japanese Patent Application No. 2012-191458 filed on Aug. 31, 2012. The entire disclosure of Japanese Patent Application No. 2012-191458 is hereby incorporated herein by reference.

BACKGROUND

1. Technical Field

The present invention relates to a recording apparatus that performs printing (textile printing) to, mainly, a fabric.

2. Background Technology

As the recording apparatuses of this kind, it is well known that an inkjet recording apparatus performs printing to a fabric by ink discharge (see Patent Document 1). The inkjet recording apparatus is provided with a platen that supports a fabric from the lower side so as to become horizontal, a pair of conveyance rollers that conveys the fabric along the platen, a guide rail that horizontally extends in the upper side of the platen, and a carriage that is slidably provided to the guide rail, and a recording head that is mounted on the carriage. The guide rail is extended in a direction intersecting the conveyance direction of the fabric, and the recording head scans in a direction intersecting the conveyance direction by using the carriage so that an appropriate ink discharge is performed. Also, the carriage is placed in the downstream side of the conveyance direction with respect to the recording head, and it is provided with an optical sensor that detects the reflected light intensity of the fabric. The optical sensor scans with the recording head, and the reflected light intensity is measured by emitting detection light to the surface of the fabric so that seams of the fabric or quantity of preconditioning agent applied to the fabric is detected. Because of this, the ink discharge is not performed to the seams of the fabric that becomes an unnecessary part later, and the concentration of the ink is controlled in response to the quantity of preconditioning agent.

Japanese Laid-open Patent Publication No. 2005-349751 (Patent Document 1) is an example of the related art.

SUMMARY

Problems to be Solved by the Invention

By the way, when the fabric is fed (conveyed), there is a case that turning up or wrinkle is generated in the both end portions of the width direction. Also, the fabric has thick seams in which the both end portions are overlapped and jointed each other. Because of this, in the well-known technology as described above, when the print (textile printing) is performed to the fabric by the inkjet method, the printing is not appropriately performed to the portion of the seams and the portion lifted from the feed route caused by the turning up or the wrinkle, and the like, and in addition, there is a problem that the lifting portion and the portion of the seams are interfered with the nozzle surface of the recording head. Thus, it was considered that an optical sensor enabling to emit coherent detection light (laser light) is used, and a lifting portion and the like in a fabric is detected by the detection light emitted along the surface of the fabric. On the other hand, there are various different thicknesses of fabrics such as a silk, which is extremely thin, or a carpet, which is extremely thick. Because of this, when the detection light is emitted along the surface of the fabric, the fine adjustment for an installation height of the light sensor is required depending on a type of the fabrics, or every time, an adjustment (calibration) of the detection/non-detection threshold value is required to perform by using a laser light having a large spot diameter. Either case assumes that the adjustment operations become extremely complicated, and in the latter case, the change amount of the adjustment in each type becomes small so that it assumes that error detections are easily produced.

An advantage of the invention is to provide a recording apparatus that detects unevenness such as a lifting on a recording medium in a medium detection section by detection light emitted along a surface of the recording medium without any adjustment of an installation position or a threshold value even though a thickness of recording mediums is different.

Means Used to Solve the Above-Mentioned Problems

A recording apparatus of the invention is provided with an apparatus main body having an arrangement surface that a recording medium is placed; a printing section having a print head, which performs printing to the recording medium, and having a movable and adjustable configuration in a separate direction with respect to the arrangement surface; and a detection section detecting unevenness on a surface of the recording medium by detection light emitted along the arrangement surface. At least one of the recording medium and the print head relatively moves in a parallel direction of the arrangement surface with respect to the other one, and the detection section synchronously moves with the printing section in the separate direction.

Another recording apparatus of the invention is provided with an apparatus main body having an arrangement surface that a recording medium is placed; a printing section having a print head, which performs printing to the recording medium, and having a movable and adjustable configuration in a separate direction with respect to the arrangement surface; and a detection section detecting unevenness on a surface of the recording medium by detection light emitted along the arrangement surface. At least one of the recording medium and the print head relatively moves in a parallel direction of the arrangement surface with respect to the other one, and the detection section has a sensor main body that has a laser emitting section and a laser receiving section, and a reflective plate that faces to the sensor main body and is across the arrangement surface. Among the sensor main body and the reflective plate, at least the sensor main body synchronously moves with the printing section in the separate direction.

In this configuration, the medium detection section that detects unevenness from the arrangement surface of the recording medium by the detection light emitted along the surface of the arrangement surface (recording medium) is configured movable and adjustable in the separate direction with respect to the arrangement surface, and synchronously moves with the printing section in the separate direction so that even though the thickness of the introduced recording medium changes, the detection section is moved and adjusted with the printing section. Therefore, the detection section is not required to perform an adjustment of the installation position or the detection threshold value even though the thickness of the recording medium is different. That is, once the detection section performs an initial setting, it is not necessary to perform an adjustment of height or angle, or an adjustment (calibration) of the detection/non-detection threshold value every time. Further, in a case that the detection section is configured by the sensor main body and the reflective plate, only the sensor main body can be mounted on the printing section side, and also, in this case, it is not necessary to perform an adjustment of the installation position or the detection threshold value even though the thickness of the recording medium is different. However, in this case, the reflective plate is required to have a length in response to the distance of the moving adjustment of the printing section. Also, the laser emitting section and the laser receiving section are formed integral so that it can be easy to adjust the installation of the detection section.

In this case, it is further provided with a gap adjustment section that moves the printing section with respect to the apparatus main body and adjusts a gap between a nozzle surface of the print head and the recording medium on the arrangement surface. It is preferable that the sensor main body is attached to a part moving with the printing section in the gap adjustment section.

In this configuration, the sensor main body is installed in a part moving with the printing section of the gap adjustment section so that it is not necessary to install the sensor main body in a part in the printing section side or it is not necessary to process for the installation. Therefore, the effect of the case that the sensor main body is installed in the printing section side can be excluded.

Further, it is preferable that a spot diameter of the laser light in the laser light section is 1 mm to 3 mm.

In this configuration, the change amount of the threshold value setting in the sensor main body becomes large so that the unevenness (lifting) of the recording medium can be accurately detected.

Also, it is preferable that a control section is further provided to stop the relative movement and the printing operation of the printing section based on the detection result in the detection section.

In this configuration, when a lifting of the recording medium is detected, it stops the relative movement and the printing operation of the printing section so that a printing error or unnecessary ink consumption can be suppressed.

In this case, the recording medium is intermittently fed to the print head in a pitch of a print span by the print head, and it is preferable that with respect to the print head, the detection section is provided with a space of at least one pitch of the intermittent feed in an upstream side of a recording medium feed direction.

In this configuration, in the state that the relative displacement and the printing operation of the printing section are stopped, unevenness (lifting) of the recording medium can be fixed and after that, it continues the printing. Also, when the unevenness of the recording medium occurs at vicinity of the seams of the recording medium or at vicinity of the end portion of a pattern, the printing is completed up to the seams or the end of the pattern and then, the printing can be stopped.

Further, it is preferable that the recording medium is a fabric; and the apparatus main body has an arrangement surface, an endless conveyance belt that feeds the recording medium in the state of being adhered, and a feed guide that is located directly under the light path of the detection light and guides the conveyance belt to be along the arrangement surface.

In this configuration, even if the recording medium has a characteristic that tends to generate a lifting (unevenness) such as turning up, wrinkle, and the like, it has a configuration that the recording medium is adhered to the conveyance belt and the recording medium is fed so that it can prevent a fabric from lifting as much as possible. Also, twists are not generated in the conveyance belt by the feed guide so that it can be prevented from producing error detections caused by generating twists on the recording medium that are generated because the conveyance belt was twisted.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, an inkjet recording apparatus according to the recording apparatus in one embodiment of the invention will be described in reference to the drawings. The inkjet recording apparatus prints (textile printing) a pattern, and the like on a fabric (original fabric) that a supplied material is removed in so-called reel-to-reel format, in the inkjet method by using a dedicated dye ink. By the way, in the description below, it is defined that a forward and reverse feed direction of a recording medium, which is a fabric, is the direction of the X axis. Also, it is defined that a direction intersecting the direction of the X axis is the direction of the Y axis. Further, it is defined that a direction intersecting the direction of the X axis and the direction of the Y axis is the direction of the Z axis.

Figure 1:
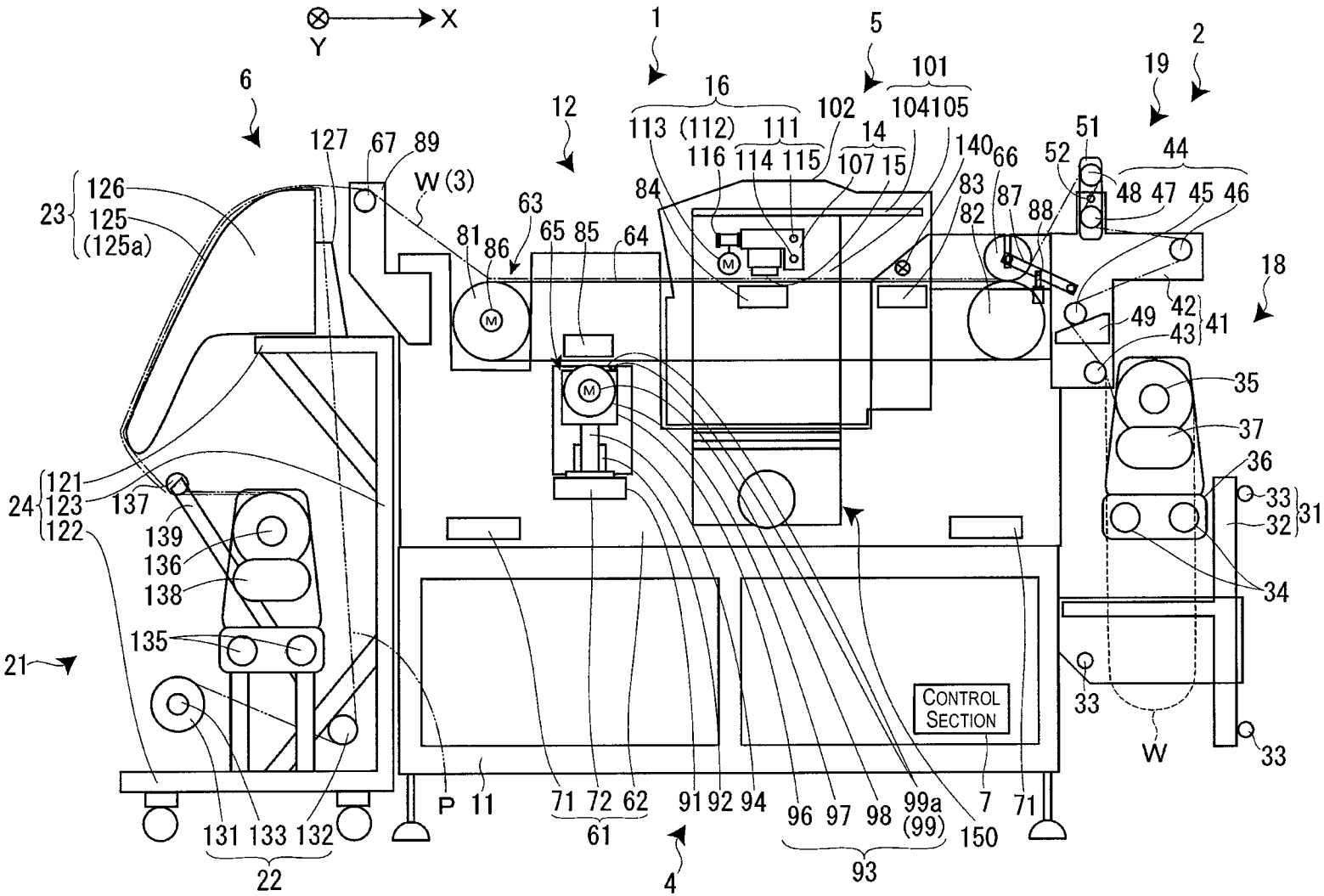
FIG. 1 is a cross-section structural diagram schematically showing an inkjet recording apparatus according to an embodiment.

FIG. 1 is a cross-section structural diagram of an inkjet recording apparatus. As shown in the drawing, the inkjet recording apparatus 1 is provided with a feed section 2 that feeds and sends a recording medium W, which is rolled in a roll shape, an apparatus main body 4 that sends the fed recoding medium W along a feed route 3 for printing, a printing section 5 that is placed upper side of the apparatus main body 4 and performs printing to the recording medium W by the inkjet method in cooperation with the apparatus main body 4, a winding section 6 that takes up and collects the recording medium W printed by the printing section 5 in the downstream side of the feed direction of the apparatus main body 4, and a control section 7 that totally controls these components.

The apparatus main body 4 is provided with a machine stand for main body 11 that is configured by combining steel materials, a medium feed mechanism 12 that is supported by the machine stand for main body 11 and intermittently feeds the recording medium W by a belt conveyance in the direction of the X axis. The printing section 5 is provided with a carriage unit 14 that has an inkjet head 15, and a head moving mechanism 16 that reciprocates the carriage unit 14 in the direction of the X axis. On the other hand, the feed section 2 is provided with a feed unit 18 that feeds the recording medium W, and a slack removing unit 19 that removes slack of the fed recording medium W. Also, the winding section 6 is provided with a winding unit 21 that winds the recording medium W, an interleaf unit 22 that supplies an interleaf P to the winding unit 21, and a heater unit 23 that vaporizes solvent (fluid) of dye ink soaked in the recording medium W before winding the recording medium W, and it has a configuration that these components are mounted on a machine stand for winding section 24.

A slack of the recording medium W (fabric) fed from the feed unit 18 is removed so as to be stretched by the slack removing unit 19 and the recording medium W is fed to the medium feed mechanism 12. The recording medium W fed to the medium feed mechanism 12 is adhered to a surface and conveyed by the belt. In this belt conveyance, the recording medium W is intermittently fed in the direction of the X axis (sub-scanning). On the other hand, synchronizing with this, the carriage unit 14 reciprocates in the direction of the Y axis and the ink is discharged from the inkjet head 15 (main scanning).

After a printing was performed in this way, a part of the recording medium W where the printing has already been done (printed part) is fed to the winding section 6 from the medium feed mechanism 12. In the winding section 6, an interleaf P is continuously supplied from the interleaf unit 22 to the recording medium W fed from the medium feed mechanism 12 so that the recording medium W and the interleaf P are overlapped and they are fed to the heater unit 23. In the heater unit 23, the recording medium W is heated with the interleaf P and the solvent (fluid) of the dye ink is vaporized. Because of this, the printed recording medium W that was dried is wound in the winding unit 21 with the interleaf P.

Figure 2:
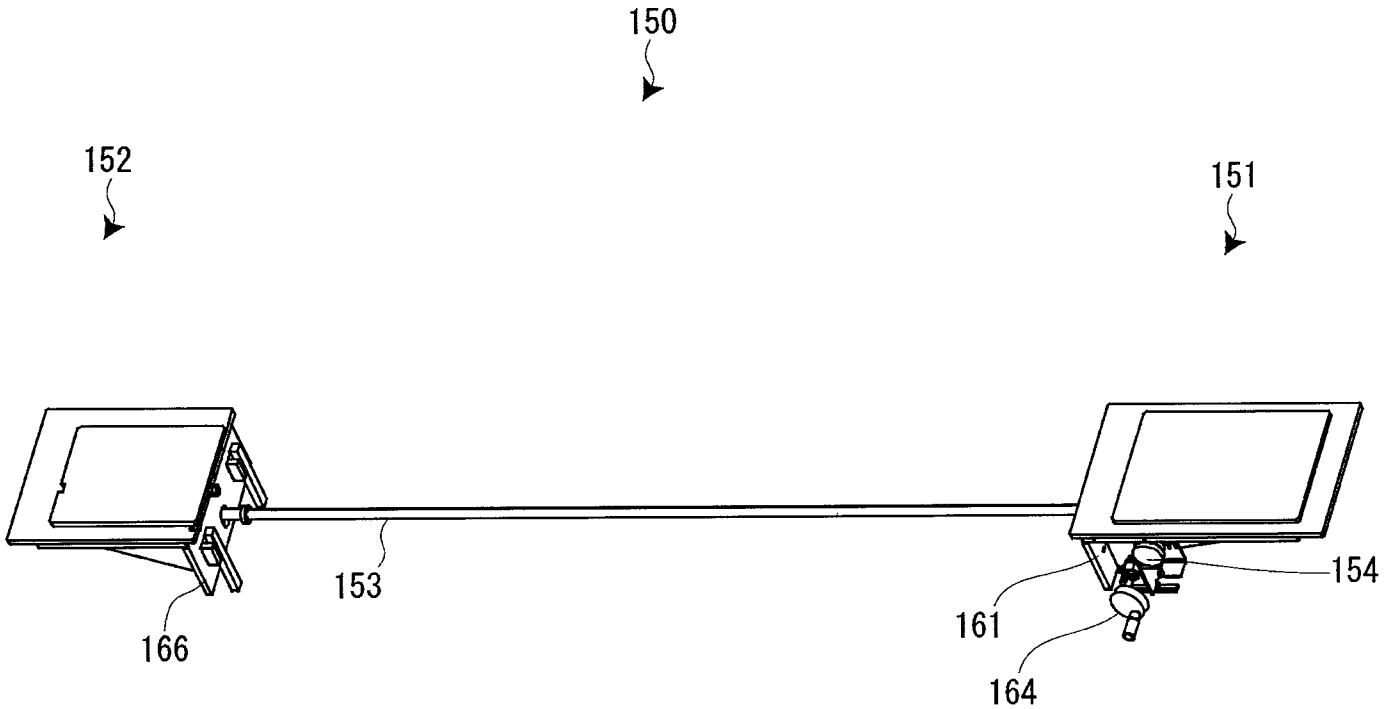
FIG. 2 is a perspective view of a gap adjustment section as a whole.
Figure 3:
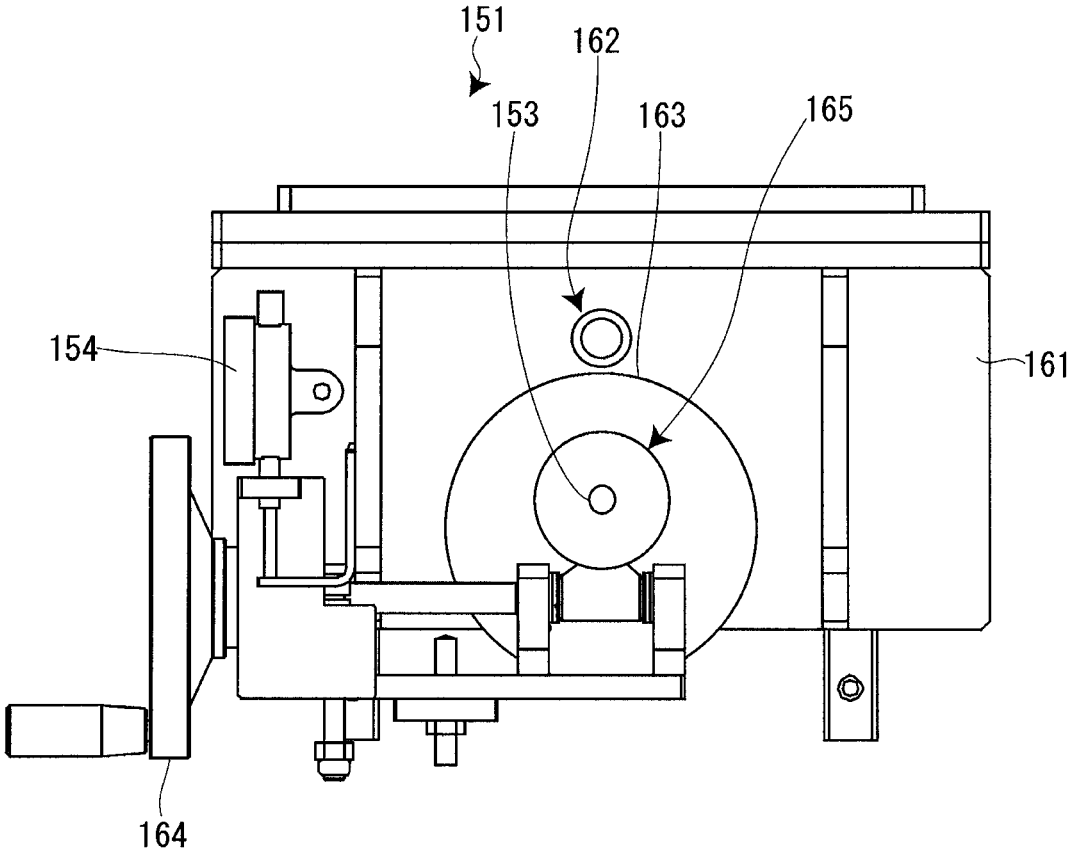
FIG. 3 is a front view of a left adjustment section of the gap adjustment section.

As shown in FIG. 1, FIG. 2 and FIG. 3, the feed unit 18 is provided with a feed frame 31 that includes of a pair of T-shaped frames 32, which are arranged on the left and right (direction of the Y axis), fixed in the above described machine stand for main body 11 and a plurality of rod-shaped frames 33 across between the pair of T-shaped frames 32, two feed-side rod bases 34 that extend in the direction of the Y axis and support the pair of T-shaped frames 32 in both ends, and a pair of feed shaft protrusions 35 that is slidably supported by the two feed-side rod bases 34. A tip of the respective feed shaft protrusions 35 forms a truncated cone shape. The pair of feed shaft protrusions 35 horizontally supports the recording medium W by bringing them near each other in the width corresponding to the width of the recording medium W and fitting the respective tips to the core of the roll-shaped recording medium W.

In the pair of feed shaft protrusions 35, a width movement unit 36 driven by a motor is respectively provided. When a winding slippage in the axial direction is caused in the recording medium W (detection), the pair of feed shaft protrusions 35 performs micro movement on the two feed-side rod bases 34 so that it is prevented from a position misalignment in the width direction with respect to the medium feed mechanism 12 of the recording medium W. That is, it is prevented from meandering (skew) the recording medium W in the medium feed mechanism 12.

Also, in one of the pair of feed shaft protrusions 35, a rotation unit 37 driven by a motor is provided. By the rotation unit 37, the recording medium W is fed by rotating the pair of feed shaft protrusions 35. In the present embodiment, there are a tension mode that feeds the recording medium W with a certain tension and a loosening mode that feeds the recording medium W by reducing tension as much as possible so that a mode switch is performed depending on a different recording medium W.

In the tension mode, this is used for a normal fabric (recording medium W) having a low elongation and contraction property, and in this case, in the control system of the rotation unit 37, the control section 7 controls the rotation unit 37 to take a load (tension) so that the load becomes a predetermined value. On the other hand, in the loosening mode, this is used for a fabric (recording medium W) having a high elongation and contraction property such as, for example, stocking material. In this case, the fed recording medium W is once loosened on the lower side (indicating in a broken line in FIG. 1), and it controls the recording medium W is sent to the slack removing unit 19. Specifically, a lower part of the loosened recording medium W is detected so that when the loosening of the lower part is largely crossed over a predetermined position, the feed operation of the recording medium W by the rotation unit 37 is stopped.

The slack removing unit 19 is provided with a slack removing frame 41 that includes a pair of L-shaped frames 42, which are arranged on the left and right (direction of the Y axis), fixed in a side frame 62 of the medium feed mechanism 12, which will be described later, and a rod frame 43 across between the pair of L-shaped frames 42, and a roller group 44 that is rotatably supported by the pair of L-shaped frames 42 in the both ends. The roller group 44 is provided with the first roller 45, the second roller 46, the third roller 47, and the fourth roller 48 in the order from the upstream side in the feed direction so that the feed route 3 of the recording medium W fed from the feed unit 18 is bent at a plurality of locations.

The first roller 45 is configured by a roller having high coefficient of friction, and the both ends of the first roller are mounted on a pair of inclined blocks 49 that is attached on the inner side of the respective L-shaped frames 42. In the state that the upstream side of the recording medium W has got loose, the route is changed diagonally outward toward the second roller 46 at the section of the first roller 45. The recording medium is pulled (fed) by the intermittent feed of the medium feed mechanism 12, and the first roller 45 moves as to climb the pair of inclined blocks 49 by the friction force between the recording medium W and the first roller 45. Also, when feeding the recording medium W stops, the first roller 45 goes down the pair of inclined blocks 49 by its own weight so as to return to the original position. Because of this, an appropriate tension is given to the recording medium W that is going to be fed, and a shock of the intermittent feed is absorbed.

The recording medium W that passes the first roller 45 makes a U-turn at the second roller 46 and reaches to the third roller 47 and the fourth roller 48. The third roller 47 and the fourth roller 48 are vertically provided in the vicinity to each other, and are rotatably supported by the pair of bearings 51 in which the both ends integrally formed. Also, the respective bearings 51 are rotatably supported by the L-shaped frames 42, and in one of the bearings 51, an angle adjustment unit 52 that adjusts a set angle of the third roller 47 and the fourth roller 48 in vertical is provided.

A route for the recording medium W that passes the third roller 47 and the fourth roller 48 is changed to the "S" shape, but the "S" shape is adjustably changed in response to the type of the recording medium W so that an appropriate tension can be given depending on a different type of the recording medium W. Because of this, a slack or a crinkle portion is removed and the recording medium W is fed to the medium feed mechanism 12. By the way, it is preferable that these rollers 45, 46, 47, 48 have a convex shape so that a component force is functioned to the recording medium W outward from the center thereof.

As shown in FIG. 1, the medium feed mechanism 12 is provided with a main body frame 61 that has the pair of side frames 62, which are arranged on the left and right (direction of the Y axis), mounted and fixed on the above described machine stand for main body 11, a belt conveyance unit 63 that is supported by the pair of side frames 62 and has an endless conveyance belt 64, and a belt washing unit 65 that is provided in the lower side of the belt conveyance unit 63. Also, the medium feed mechanism 12 is provided with a pressing roller 66 that engages to the belt conveyance unit 63 from upper side in the upstream side, and a separating roller 67 that is provided diagonally upward with respect to the belt conveyance unit 63 in the downstream side.

The main body frame 61 is provided with the pair of side frames 62 that is configured by a thick board, and a pair of coupling frames 71 that are arranged the front and back (direction of the X axis) and couples the pair of side frames 62 so that it is mounted and fixed on the machine stand for main body 11 by the pair of side frames 62. Also, the pair of the coupling frames 71 is sandwiched in between the pair of side frames 62 so that they are coupled, and the main body frame 61 has a support frame 72 to support the above described belt washing unit 65. In the respective side frames 62, a notch for mounting the belt conveyance unit 63 and a notch for mounting the printing section 5 are arbitrarily provided, and an opening section is formed to check the belt washing unit 65.

The belt conveyance unit 63 is provided with a drive pulley 81 that is located in the downstream side of the feed direction, a driven pulley 82 that is located in the upstream side of the feed direction, and an endless conveyance belt 64 that bridges between the drive pulley 81 and the driven pulley 82. Also, the belt conveyance unit 63 is provided with a first guide plate 83 that is located near the driven pulley 82 and guides to drive the conveyance belt 64, a second guide plate 84 that is located directly below the printing section 5 and guides to drive the conveyance belt 64, and a third guide plate 85 that is located directly below the above described support frame 72 and guides to drive the conveyance belt 64, which traveled around the back side.

In the state that the mutual surfaces of the first guide plate 83 and the second guide plate 84 are arranged so as to become a flush surface (the same horizontal surface), the pair of side frames 62 are bridged so that it is functioned as a part of the main body frame 61. Also, the first guide plate 83 guides the conveyance belt 64 (of the upper side) immediately after leaving from the driven pulley 82 so that it is driven horizontally, and the second guide plate 84 guides the conveyance belt 64 (of the upper side) located in a print area without any slack. Therefore, the conveyance belt 64 located directly above the second guide plate 84 functions as a platen. In addition, the third guide plate 85 guides the conveyance belt 64 so as to press the push-up power received from the belt washing unit 65 (the detail will be described later).

The drive pulley 81 and the driven pulley 82 are rotatably supported by the pair of side frames 62 through the dedicated bearing, and one axial end of the drive pulley 81 couples to a conveyance motor 86 to intermittently drive the conveyance belt 64. The conveyance belt 64 is configured by a wide special belt that has adhesiveness (adhesion process) on the outer periphery (surface) so that the recording medium W is stuck and fed in the direction of the X axis. Because of this, in directly below the printing section 5, the recording medium W is fed for a printing (intermittent feed) without causing burr, and the like.

In the upper side of the driven pulley 82, the pressing roller 66 that sticks the recording medium W, which was fed from the slack removing unit 19, to the conveyance belt 64 is provided. The pressing roller 66 is rotatably supported by a tip part of a pair of support arms 87 that are rotatably supported by the side frames 62. Also, the pressing roller 66 has a predetermined elasticity and own weight, and by its own weight, it presses the recording medium W to the conveyance belt 64 in directly above the driven pulley 82. That is, the pressing roller 66 and the driven pulley 82 sandwiches the conveyance belt 64 and functions as a nip roller so that the recording medium W is continuously stuck on the conveyance belt 64 that is driven. By the way, in the intermediate position of the respective support arms 87, an air cylinder 88 is coupled for rotating the support arms 87, and the pair of air cylinders 88 is synchronously driven so that the pressing roller 66 is separated from the conveyance belt 64.

On the other hand, in a position diagonally upward the drive pulley 81, the separating roller 67 feeding to the winding section 6 is provided to separate the recording medium W from the conveyance belt 64 after the printing. The separating roller 67 is rotatably supported by a pair of sub-frames 89 extending from the side frames 62. In this case, the separating roller 67 relatively separates the recording medium W from the conveyance belt 64 that circles around and goes around to the back side of the drive pulley 81, but in an actual operation, a separation power from the conveyance belt 64 is different depending on a type of the recording medium W. Because of this, depending on a type of the recording medium W, there is a case that the separation starts in a position where the conveyance belt 64 starts the round, or there is a case that the separation starts in a position where the round has progressed to certain extent. However, when a point of the separation goes round on the back side, it is likely to get the recording medium W caught in the conveyance belt 64.

Accordingly, in the present embodiment, an angle of the recording medium W fed from the conveyance belt 64 to the separating roller 67 is detected, and the winding unit 21 is driven to wind based on the detection result of the position detection so that it prevents a point of the separation from going round on the back side of the conveyance belt 64.

As shown in FIG. 1, the belt washing unit 65 is supported by the above described support frame 72 in the lower side of the conveyance belt 64, and extends in the direction of the Y axis as to cross the conveyance belt 64. The belt washing unit 65 is provided with a unit base 91 that is mounted on the support frame 72, a lifting cylinder 92 that is provided so as to stand in the unit base 91, a washing unit main body 93 that is lifted by the lifting cylinder 92, and a pair of lifting guides 94 that guides to move up and down the washing unit main body 93.

Further, the washing unit main body 93 is provided with a boxlike washing container 96 that extends in the direction of the Y axis and reserves wash solution, a rotating brush 97 that is stored in the washing container 96, a washing motor 98 that rotates the rotating brush 97, and a wiper 99 that relatively wipes out the wash solution sticking on the conveyance belt 64. The wiper 99 is disposed inside of the wash container 96, and is configured by two wiping blades 99*a* provided in "V" shape, and contacts to the conveyance belt 64 that is driven so as to wipe out the wash solution. By the way, ultimately remaining wash solution on the conveyance belt 64 is wiped out by a waste cloth. Also, it is preferable that the wash solution is circulated while filtering in between the external tank.

In the conveyance belt 64 having adhesiveness, lint or dust is adhered depending on time so that the washing to the conveyance belt 64 by the belt washing unit 65 is performed periodically. In the washing operation, after lifting the washing unit main body 93 to the position where the rotating brush 97 and the wiper 99 contact to the conveyance belt 64, the conveyance belt 64 is driven and the rotating brush 97 is rotated in the direction opposite to the driving direction of the conveyance belt. In this time, the conveyance belt 64 is pressed by the above described third guide plate 85, and contacts with the rotating brush 97 while maintaining the horizontal-position. Because of this, the conveyance belt 64 (of adhesive surface) is continuously washed by brushing. By the way, after the washing, it is preferable to perform an adhesion process to recover the adhesion of the conveyance belt 64.

As shown in FIG. 1, the printing section 5 is provided with a printer frame 101 that extends in the direction of the Y axis to stride over the feed route 3 (belt conveyance unit 63), a head moving mechanism 16 that is supported by the printer frame 101, a carriage unit 14 that reciprocates the head moving mechanism 16 in the direction of the Y axis, and a printer cover 102 that covers these components. Also, it is not specifically drawn, but in the printing section 5, a cap unit and a cleaning unit that maintain the inkjet head 15 are provided. By the way, so-called paper gap (workpiece gap) in the printing section 5 has a range of thickness in various recording mediums W so that it is adjusted by lifting entire printing section 5 with respect to the apparatus main body 4 (medium feed mechanism 12).

As shown in FIG. 1, the printer frame 101 is provided with a beam-shaped frame 104 made of the sheet metal that extends in the direction of the Y axis and a pair of stand frames 105 made of the sheet metal that supports the beam-shaped frame 104 in the both ends. In the pair of stand frames 105, the above described side frames 62 are supported. By the way, the printer cover 102 is mounted on this printer frame 101.

A carriage unit 14 is provided with the inkjet head 15 that has plural colors of nozzle lines for color print and a carriage 107 that holds the inkjet head 15 in which the nozzle surface is facing down. By the way, each color of dye inks supplied to each nozzle line is supplied from so-called off-carriage ink tank.

The head moving mechanism 16 is provided with a carriage guide 111 that slidably supports the carriage unit 14 in a cantilever in the direction of the Y axis, a belt conduction mechanism 112 that reciprocates the carriage guide 111, and a carriage motor 113 that drives the belt conduction mechanism 112. The carriage guide 111 is composed of a main guide 114 in a lower side and a sub-guide 115 in an upper side. The main guide 114 and the sub-guide 115 support the above described pair of stand frame 105 in its both ends. The belt conduction mechanism 112 is provided with a timing belt 116, and a part of the timing belts 116 is fixed to the carriage unit 14 (carriage 107).

When the timing belt 116 is reciprocally driven by a carriage unit 14, the carriage guide 111 is guided to reciprocate in the direction of the Y axis. A moving position of the carriage guide 111 is detected by a linear encoder, and each color of the dye inks is selectively discharged from the inkjet head 15 based on the detection result and the print data. Because of this, the printing (textile printing) to the recording medium W is performed. By the way, when the recording medium has unevenness such as a lifting, and the like caused by turning up, and the like, an appropriate printing cannot be performed. The details will be described later. Thus, in the upstream side of the printing section 5, it can detect the unevenness (specifically, it is a convex portion).

As shown in FIG. 1, the winding section 6 is provided with the machine stand for winding section 24 that detachably couples to the machine stand for main body 11 in the direction of the X axis, the heater unit 23 that is supported by the upper part of the machine stand for winding section 24, the winding unit 21, and the interleaf unit 22 that are supported by the lower part of the machine stand for winding section 24. For the printed recording medium W, there is a method for directly winding a thick recording medium W, which does not get ink offset, and there is a method for winding a thin recording medium W, which easily gets ink offset, overlapped with an interleaf P. It has a design available to any method. The case that the latter method is employed will be described below.

The machine stand for winding section 24 is provided with an upper horizontal frame section 121, a lower horizontal frame section 122, and a vertical frame section 123 that couples the upper horizontal frame section 121 and the lower horizontal frame section 122. They are configured by lengthwise and breadthwise combining the extruded shape materials of aluminum. And, the vertical frame section 123 is detachably coupled to the machine stand for main body 11.

The heater unit 23 is provided with a heat release plate 125 that has an arc-like heat release surface 125*a*, and a heater 126 that is attached inside in the heat release plate. Also, in the state that the upper half section of the heater unit 23 is mounted on the upper horizontal frame section 121, the heater unit 23 is fixed to the upper horizontal frame section 121 by left and right fixing members 127 provided in the upper horizontal frame section 121. The top end of the heat release plate 125 is provided in a position that is adjacent to the above described separating roller 67 and is slightly lower than the separating roller 67. Also, the top end of the heat release plate 125 is bent in an arc shape, which is facing down, to change a route for an interleaf P introduced from the lower side of this section.

The recording medium W that passed the separating roller 67 overlaps with the interleaf P fed from the lower side in the top end of the heat release plate 125 and is fed to the lower side along the arc-shaped outer surface (heat release surface 125*a*) of the heat release plate 125. The recording medium W and the interleaf P that are vertically fed by slidably contacting to the heat release surface 125*a* are continuously heated by the heater 126. By this heat, the solvent (fluid) of the dye ink soaked in the recording medium W is vapored so that the dye is fixed to the fabric.

The interleaf unit 22 is provided with an interleaf roller 131 that feeds a roll-shaped interleaf P, and a guide bar 132 that changes a route of the fed interleaf P toward the top end of the heat release plate 125. The guide bar 132 is fixed in a part of a diagonal member that couples between the lower horizontal frame section 122 and the vertical frame section 123. Also, the interleaf roller 131 is supported in the front part of the lower horizontal frame section 122 through the pair of bearing units 133 that is provided with a damping mechanism. The interleaf P is fed without causing any slack by the pair of bearing units 133.

The winding unit 21 is supported by the rear section of the lower horizontal frame section 122 in the same manner as the above described feed unit 18. The winding unit 21 is provided with two winding side rod bases 135 that extend in the direction of the Y axis, and a pair of winding shaft projections 136 that is slidably supported by the two winding side rod bases 135. Also, the winding unit 21 is located in the feed route 3 between the bottom end of the heat release plate 125 and the pair of winding shaft projections 136, and has a tension roller 137 that gives a tension to the recording medium W and the interleaf P.

The top end of the respective winding shaft projections 136 is formed in a truncated cone shape, and the respective top ends of the pair of winding shaft projections 136 are engaged to the winding core winding the recording medium W by mutually aligning the width of the recording medium W so that it is horizontally maintained. One side of the pair of winding shaft projections 136 provides a rotation unit 138 driven by a motor so that the pair of winding shaft projections 136 is rotated and the recoding medium W and the interleaf P are simultaneously wound. Further, in the position adjacent to the separating roller 67 as described above, the rotation unit 138 is controlled based on the angle detection of the recording medium W fed to the separating roller 67.

A tension roller 137 is rotatably supported by the end part of a pair of turn arms 139 that is rotatably supported in the rear part of the lower horizontal frame section 122. And, the tension roller 137 rotationally contacts to the interleaf P side of the recording medium W, which is wound in the winding core, and the interleaf P. The recording medium W and the interleaf P are biased so as to turn to the lower side by the own weight of the tension roller. Because of this, an appropriate tension is given to the recording medium W and the interleaf P, and the recording medium W and the interleaf P are wound in the winding core.

Next, in reference with FIG. 2 and FIG. 7, a medium detection section 140 that detects unevenness such as a lifting, and the like of the recording medium on the conveyance belt 64 (detection section) will be described in detail, and related to this, a gap adjustment section 150 adjusting a paper gap of the inkjet head 15 will be briefly described. As described above, the recording medium W is adhered to the conveyance belt 64 by own weight of the pressing roller 66 and is fed, but it tends to generate a lifting such as turning up, and the like in, specifically, the both end portions due to the degradation of the adhesion force or the aspect of the recording medium W. Also, the recording medium (fabric) has thick seams in which the end portions are overlapped and connected to each other. On the other hand, a paper gap in the printing section 5 is adjusted by lifting the entire printing section 5 with respect to the apparatus main body 4.

Even though the paper gap is appropriately adjusted, when the unevenness such as a lifting, and the like is generated on the recording medium W, a predetermined paper gap cannot be maintained partially so that it is impossible to provide a good quality textile printing (printing). Thus, in the present embodiment, in the upstream side of the printing area, the medium detection section 140 is provided to detect a lifting of the recording medium W, and also, to save many steps of performing a height adjustment, and the like of the medium detection section 140 in response to the thickness of the recording medium, the medium detection section 140 is provided with a movable component (a part in the printing section 5 side) of the gap adjustment section 150.

Figure 4:
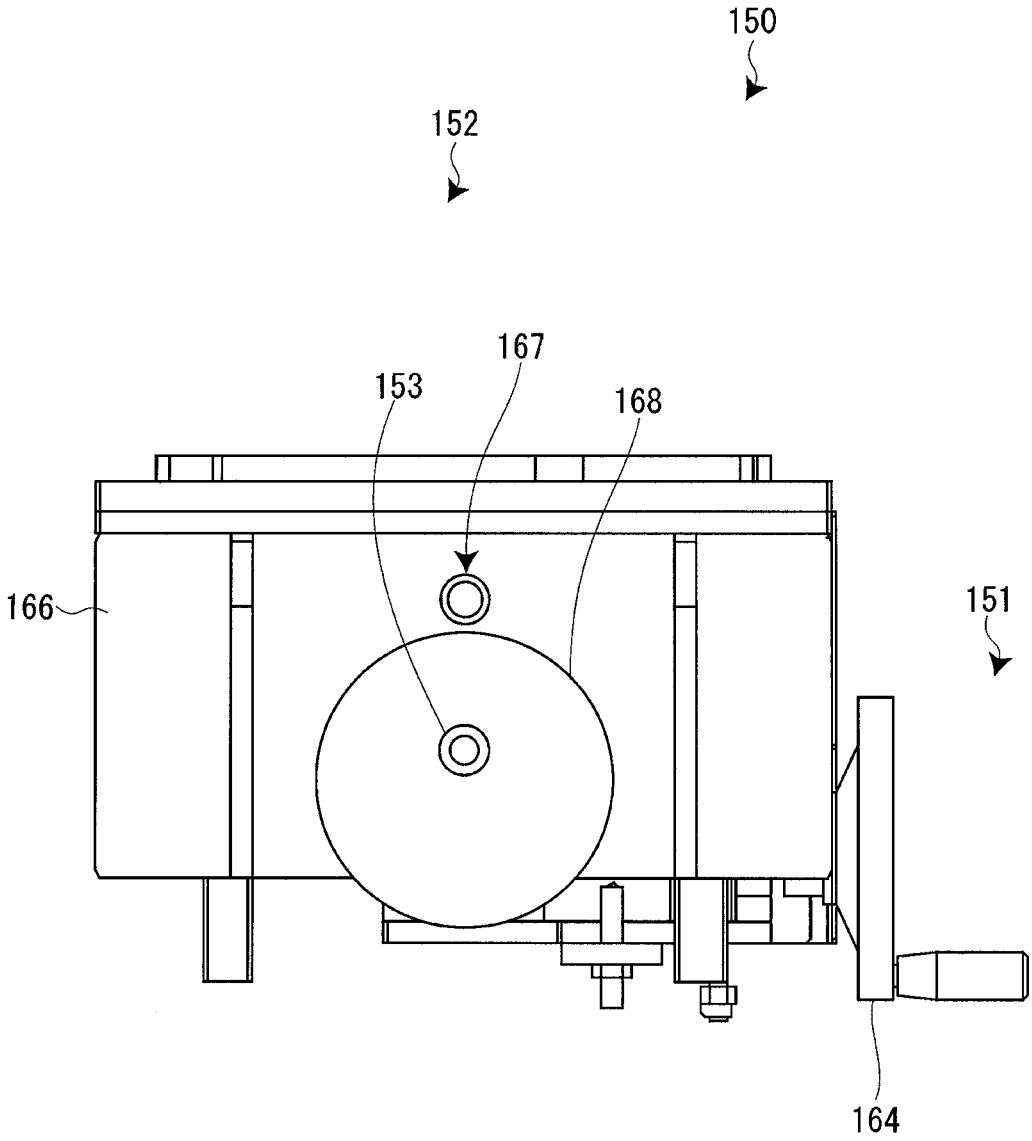
FIG. 4 is a front view of a right adjustment section of the gap adjustment section.

As shown in FIG. 2 and FIG. 4, the gap adjustment section 150 is provided with a left adjustment section 151 that lifts one end part (left part) of the printing section 5, a right adjustment section 152 that lifts the other end part (right part) of the printing section 5, a connecting shaft 153 that connects between the left adjustment section 151 and the right adjustment section 152, and a dial gauge 154 that measures a gap dimension according to the gap adjustment. And, the members in the apparatus main body 4 side of the left adjustment section 151 and the right adjustment section 152, and the connecting shaft 153 are supported by the left and right of the side frames 62.

The left adjustment section 151 is provided with a left bracket section 161 in which the left part of the printing section 5 seats, a left cam mechanism 162 that is configured by an eccentric cam 163 lifting the left bracket section 161, an operating handle 164 that operates the left cam mechanism 162, and a worm-worm wheel 165 that transforms the rotation power of the operating handle 164 to the eccentric cam 163. On the other hand, the right adjustment section 152 is provided with a right bracket section 166 in which the left part of the printing section 5 seats, and a right cam mechanism 167 that is configured by an eccentric cam 168 lifting the right bracket section 166. Also, the left cam mechanism 162 and the right cam mechanism 167 have the same configuration, and the eccentric cam 163 of the left cam mechanism 162 and the eccentric cam 168 of the right cam mechanism 167 are connected by the connecting shaft 153 so as to rotate together.

When the operating handle 164 is performed forward and reverse rotation, the left cam mechanism 162 is operated through the worm-worm wheel 165, and in addition, the right cam mechanism 167 is operated through the connecting shaft 153. That is, in accordance with the forward and reverse rotation of the operating handle 164, the left cam mechanism 162 and the right cam mechanism 167 are simultaneously operated so that the left bracket section 161 and the right bracket section 166 are simultaneously lifted. Because of this, a paper gap between the nozzle surface of the inkjet head 15 installed in the printing section 5 and the recording medium W on the conveyance belt 64 installed in the medium feed mechanism 12 is adjusted. And, in the present embodiment, a main section of the medium detection section 140 is installed in the left bracket section 161 which is a movable component of the gap adjustment section 150. That is, the main section of the medium detection section 140 is lifted with the printing section 5 by the gap adjustment section 150.

Figure 5:
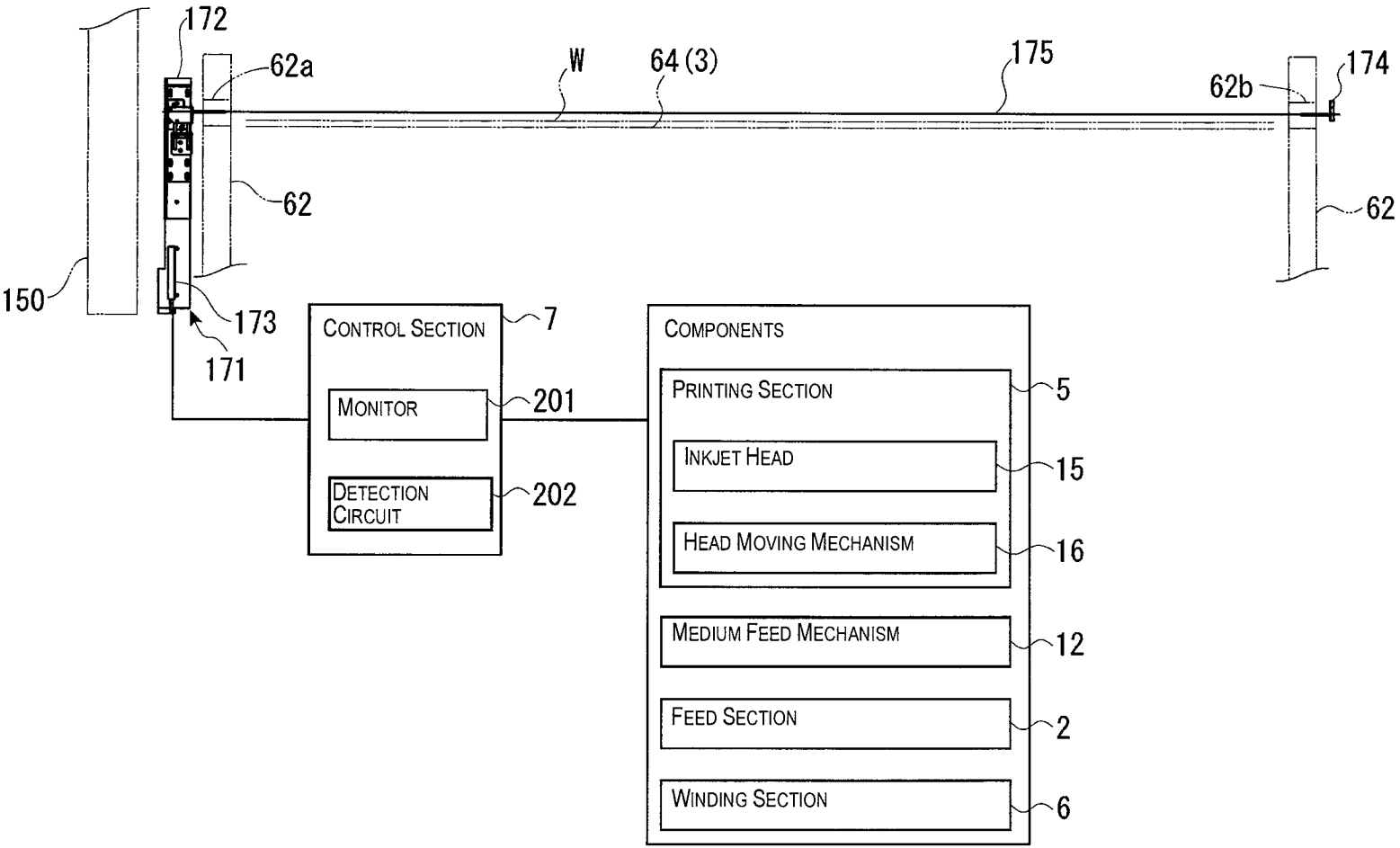
FIG. 5 is a structural diagram of an entire medium detection section.
Figure 7:
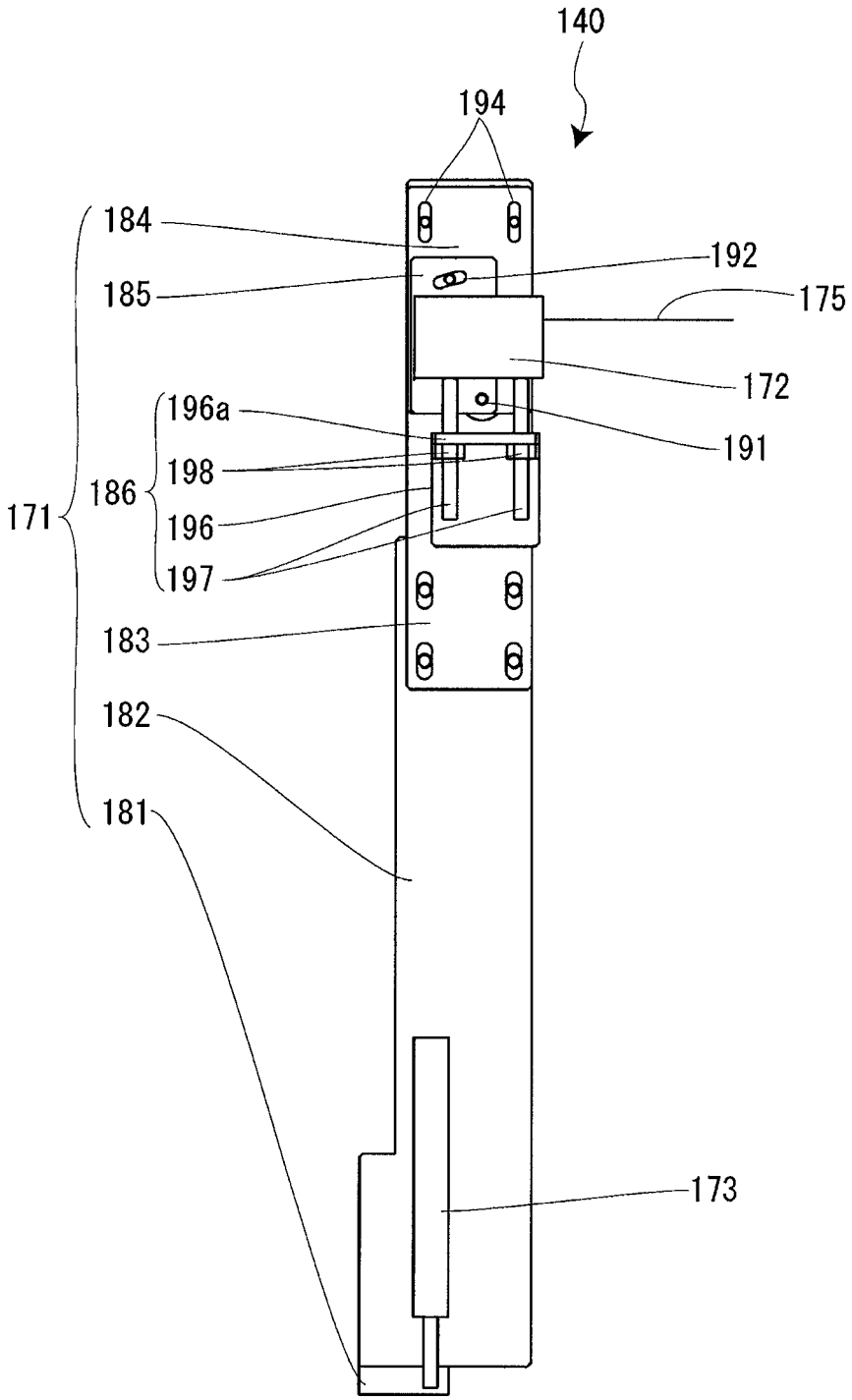
FIG. 7 is a front view of the sensor main body's surroundings of the medium detection section.

As shown in FIG. 5 and FIG. 7, the medium detection section 140 is provided with a detection section support mechanism 171 that is installed in the above described left bracket section 161, a sensor main body and an amplifier section 173 that are installed in the detection section support mechanism 171, and a reflective plate 174 installed in the right side of the side frame 62 that faces to the sensor main body 172 and is across the feed route 3. The sensor main body 172 is configured by so-called laser sensor, and a light path 175 of the laser light is set along the recording medium W, in other words, along the feed route 3, which is the arrangement surface of the recording medium W, so as to across it. Further, the amplifier 173 is connected to the above described control section 7. By the way, the medium detection section 140 can be installed in the right bracket section 166.

Figure 6:
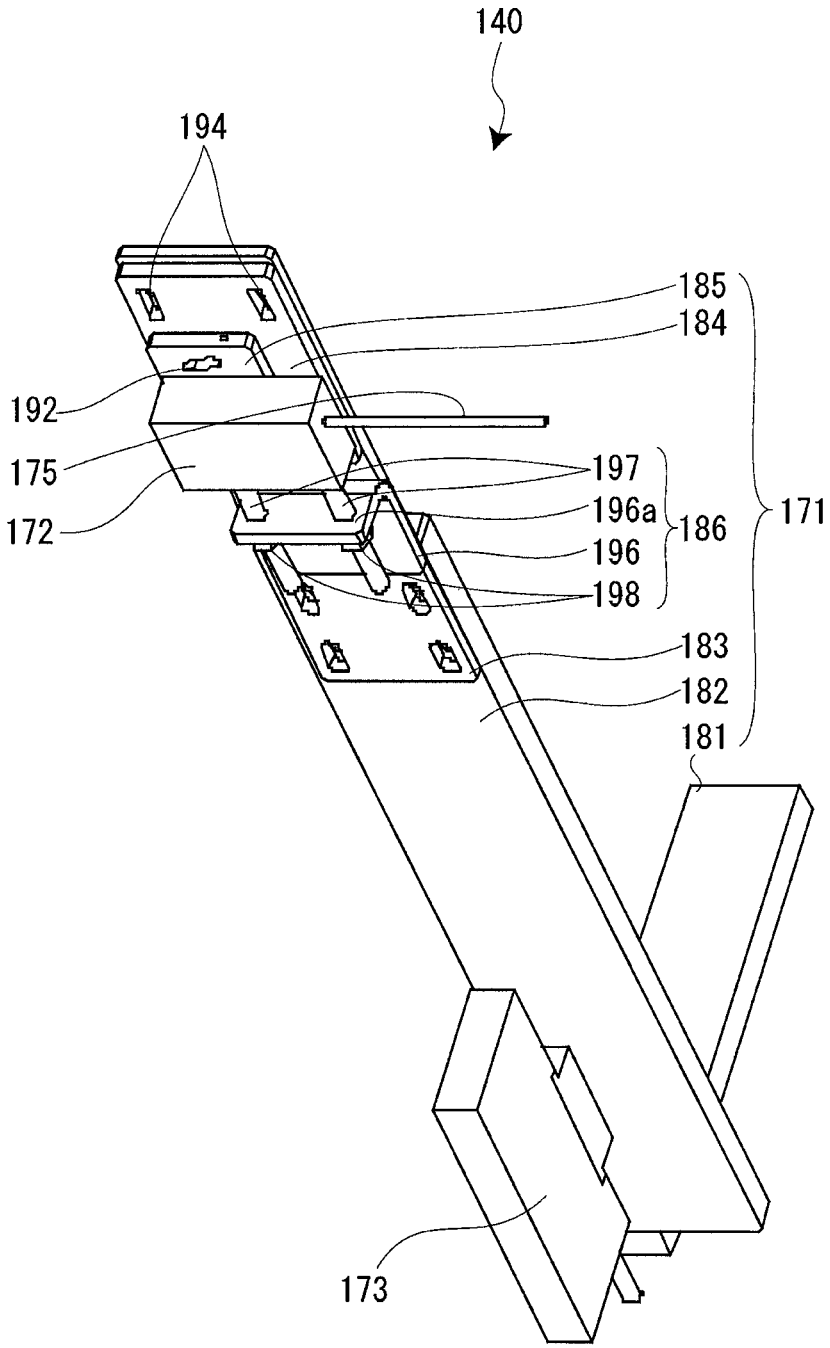
FIG. 6 is a perspective view of sensor main body's surroundings of the medium detection section.

As shown in FIG. 6 and FIG. 7, the detection section support mechanism 171 is provided with an attachment plate 181 that extends in a horizontal direction (direction of the X axis) and is attached to the left bracket section 161, a main plate 182 that extends at right angles (direction of the Z axis) to the attachment plate 181, a sub-plate 183 that is attached in the upper end portion of the main plate 182 and further extends to the upper side, a vertical angle adjustment plate 184 that is attached to the upper portion of the sub-plate 183, an angle adjustment plate 185 that is attached with the vertical angle adjustment plate 184 and holes the sensor main body 172, and an adjustment mechanism section 186 that is attached to the intermediate portion of the sub-plate 183.

Also, the amplifier section 173 is attached in the lower portion of the main plate 182. Also, the entire detection section support mechanism 171 is attached to the left bracket section 161 by screwing it to the lower surface of the left bracket section 161.

In the angle adjustment plate 185, a rotationally moving pin 191 is provided in the lower corner portion, and on the other hand, in the diagonal position with respect to the rotationally moving pin 191, an arc-like long hole for angle adjustment 192 in which the rotationally moving pin 191 is centered is formed. Also, in the vertical angle adjustment plate 184, a fixation screw, which is not shown, is screwed through the long hole for angle adjustment 192. An angle of the sensor main body 172 fixed to the angle adjustment plate 185, that is, a tilt angle of the laser light is adjusted by loosening the fixation screw and rotationally moving the angle adjustment plate 185 with the rotationally moving pin 191 as a center. And, after adjusting the tilt angle of the sensor main body 172, the adjustment is completed by tightening the fixation screw.

A pair of long holes for vertical angle adjustment 194, which extends to the vertical direction, is formed in the upper end portion of the vertical angle adjustment plate 184. In the sub-plate 183, a pair of fixation screws, which is not shown, is screwed through the respective long holes for vertical angle adjustment 194. A position of the vertical direction of the sensor main body 172, that is, the height position of the laser light is adjusted through the angle adjustment plate 185 by loosening the fixation screws and vertically moving the vertical angle adjustment plate 184. And, after adjusting the vertical position of the sensor main body 172, the adjustment is completed by tightening the pair of fixation screws.

The adjustment mechanism section 186 is provided with a "L"-shaped support bracket 196 attached to the intermediate portion of the sub-plate 183, a pair of adjusting screws 197 that screws through a horizontal piece section 196*a* of the support bracket 196, and a pair of fixation nuts 198 that screws to the adjusting screws 197. A pair of adjusting screws 197 is separately provided in the front and back direction (direction of the Y axis), and the respective top ends (upper ends) contact to the lower surface of the sensor main body 172.

The respective fixation nuts 198 are loosened. Then, one of the adjusting screws 197 is rotated forward and the other adjusting screw 197 is reversed so that the tilt angle of the sensor main body 172 is adjusted. Also, the sensor main body 172 moves up by rotating the pair of adjusting screws 197 forward, and on the other hand, it moves down by reversing so that the position is adjusted vertically. By the way, when the adjustment is completed, the fixation nuts 198 are tightened.

In a position adjustment of the sensor main body 172 by the adjustment mechanism section 186, a sheet corresponding to a paper gap preliminary lays on the conveyance belt 64. And, first, in the state that the angle adjustment plate 185 and the vertical angle adjustment plate 184 are set movable, the vertical position of the sensor main body 172 and the tilt angle are adjusted while watching a monitor 201 of the control section 7. In this adjustment, the vertical position is roughly adjusted, and the tilt angle is mainly adjusted. In the tilt adjustment, the laser is not complete coherent light. It considers to be slightly widened and it is preferable that the reflective plate 174 is slightly angled upward.

When the adjustment of the tilt angle is completed, the angle adjustment plate 185 is fixed and the fine adjustment of the vertical direction is performed. In this fine adjustment, an object corresponding to a lifting is placed on the conveyance belt 64. In this case, the vertical position of the sensor main body 172 is adjusted while watching the monitor 201 (in this case, it is preferable to adjust lower movement). However, setting a threshold value is also performed. Then, finally, the vertical angle adjustment plate 184 is fixed and the adjustment operation is completed.

The sensor main body 172 is configured by a laser sensor, and is provided with a laser emitting section and a laser receiving section. That is, the laser light emitted from the laser emitting section (detection light) is reflected at the reflective plate 174, and is received in the laser receiving section. And, when the light amount of the laser light received in the laser receiving section (actually, it is a current value) is lower than the above threshold value, it is detected that a lifting occurs on the recording medium W.

In this case, it is used that a spot diameter of the laser light (detection light) emitted from the laser emitting section is 1 mm to 3 mm (a spot diameter is 2 mm in the embodiment). Because of this, the change of the laser light received amount in a lifting portion can be larger so that the detection accuracy can be improved. Specifically, in the medium detection section 140 of the embodiment as described, the clearance between the sensor main body 172 and the reflective plate 174 is 1600 mm to 1900 mm, and it is useful for the improvement of the detection accuracy in a device configuration in which a span of adjustment range is 0 mm to 8 mm. By the way, a lifting or a seam caused by turning up or defective sticking of the recording medium W can be detected by the sensor main body 172, and needless to say, the adhesion of foreign substances, and the like can be detected.

As shown in FIG. 5, the light path 175 of the sensor main body 172 passes through a vertically long left opening section 62*a* formed in the left side of the side frame 62, and extends in the direction of the Y axis along the surface of the conveyance belt 64. In addition, it passes through a vertically long right opening section 62*b* formed in the right side of the side frame 62, and reaches to the reflective plate 174. And, the reflective plate 174 is provided to the outside of the right side of the side frame 62 so as to face onto the right opening section 62*b*. As described above, the sensor main body 172 is fixed to the left bracket section 161 in the movable side, which is lifted by the gap adjustment, and on the other hand, the reflective plate 174 is provided to the side frame 62 in the fixed side. Therefore, the length of the vertical direction of the reflective plate 174 has a dimension more than the span of the adjustment range of the gap adjustment.

By the way, the reflective plate 174 can be provided to the right bracket section 166 in the movable side. That is, it can be a configuration that the medium detection section 140 is provided to the movable part of the gap adjustment section 150.

On the other hand, as shown in FIG. 1, the medium detection section 140 is provided in the upstream side of the printing section 5 in the direction of the X axis. That is, with respect to the inkjet head 15 of the printing section 5, the light path 175 of the laser light in the medium detection section 140 is provided with a space corresponding to number of pitches of the intermittent feed in the upstream side of the feed direction of the recording medium W. Because of this, when a lifting is detected on the recording medium W, the components such as the printing section 5, the medium feed mechanism 12, and the like are stopped, and it enables to fix the lifting portion by an operator.

Also, the first guide plate 83 as described above is provided in a position directly below the light path 175 of the laser light. Because of this, twists are not generated in the conveyance belt 64, and it prevents the medium detection section 140 from producing error detections caused by generating the twists of the recording medium W, which is generated because the conveyance belt 64 was twisted.

As shown in FIG. 5, the laser light received in the laser receiving section is processed with photoelectric conversion. It is amplified by the amplifier section 173, and inputted to the control section 7. In the control section 7, the light reception amount of the laser light that was processed with the photoelectric conversion is displayed in the monitor 201, and the light reception amount (current value) and the above threshold value are compared by a detection circuit 202. And, when the light reception amount (current value) becomes lower than the threshold value (a lifting is detected), the control section 7 stops the printing section 5, the medium feed mechanism 12, and the like. Here, the operator operates to fix a lifting (or unloaded feed of the seams), and the like, and it is preferable to restart printing by the manual operation.

However, when a lifting of the recording medium W is generated in the vicinity of the seams of the recording medium W or the vicinity of end portion of the pattern, the printing is performed up to (but not including) the seams or the end portion of the pattern. After completing the printing, it can be stopped. That is, in the clearance between the print area and the light path 175, when the control section 7 detects a lifting, it determines whether or not the printing data up to (but not including) the seams or the end portion of the pattern is fitted. When it is fitted, the stopping control is performed after completing this printing, and when it is not fitted, the stopping control is performed immediately after the detection. At the same time, the status is displayed in the monitor 201.

As described above, in the present embodiment, the sensor main body 172 (medium detection section 140 that detects a lifting of the recording medium W from the feed route 3 is attached to the movable part (left bracket section 161) of the gap adjustment section 150 that adjusts a paper gap so that in accordance with the gap adjustment (in conjunction), a position of the sensor main body 172 can be automatically adjusted. Because of this, in the sensor main body 172, when its height and tilt angle is initially set, even if the thickness of the recording medium W supplied for the textile printing (printing) is changed, it is not required to adjust the height position or the tilt angle, as well as the detection threshold value. Therefore, the complicated adjustment operation of the medium detection section 140 can be omitted.

Also, according to this, a sensor main body 172 (laser sensor) having a small spot diameter can be used so that a lifting of the recording medium W can be accurately detected without any error detections and the productivity can be improved. In addition, the medium detection section 140 is provided in the upstream side of the printing section 5 so that when a lifting of the recording medium W is detected, it can properly cope with this such as stopping the device, and the like.

By the way, the invention can be applied to so-called line printer or a type of a printer that moves the inkjet head 15 in the X and Y directions (main scanning direction and sub-scanning direction).

What is claimed is:

1. A recording apparatus comprising:

an apparatus main body having an arrangement surface on which a recording medium is placed;

a printing section having a print head and a guide portion, the print head being configured to perform printing the recording medium, the guide portion being configured to guide the print head in a guide direction, the print head and the guide portion having a movable and adjustable configuration such that the print head and the guide portion synchronously move apart relative to the arrangement surface in a separate direction, the separate direction being perpendicular to the guide direction; and a detection section detecting unevenness on a surface of the recording medium by emitting detection light along the arrangement surface;

wherein at least one of the recording medium and the print head relatively moves in a parallel direction of the arrangement surface with respect to the other one, and the detection section synchronously moves with the print head and the guide portion in the separate direction.

2. The recording apparatus according to claim 1, wherein the recording medium is a fabric, wherein the apparatus main body includes an endless conveyance belt, which feeds the recording medium in the state of being adhered, and a feed guide, which is located directly below light path of the detection light and guides the conveyance belt along the arrangement surface.

3. The recording apparatus according to claim 1, wherein the apparatus main body further includes a feeding unit that is configured to feed the recording medium in a conveyance direction, and the detection section synchronously moves with the print head and the guide portion in the separate direction that is further perpendicular to the conveyance direction.

4. The recording apparatus according to claim 1, wherein the apparatus main body further includes an endless conveyance belt configured to feed the recording medium in a conveyance direction, and a feed guide having a feed surface, and the feeding surface being configured to guide the endless conveyance belt in the conveyance direction, and having a flat shape extending along the conveyance direction, and the detection section and the guide surface are aligned along the separation direction that is further perpendicular to the conveyance direction.

5. The recording apparatus according to claim 1, further comprising a control section stopping the relative movement and a printing operation of the printing section based on a detection result of the detection section.

6. The recording apparatus according to claim 5, wherein the recording medium is intermittently fed with respect to the printing head in a pitch of a print span by the print head, with respect to the print head, the detection section is provided with a space of at least one pitch of the intermittent feed in an upstream side of a recording medium feed direction.

7. A recording apparatus comprising:

an apparatus main body having an arrangement surface on which a recording medium is placed;

a printing section having a print head and a guide portion, the print head being configured to perform printing the recording medium, the guide portion being configured to guide the print head in a guide direction, the print head and the guide portion having a movable and adjustable configuration such that the print head and the guide portion synchronously move apart relative to the arrangement surface in a separate direction, the separate direction being perpendicular to the guide direction; and a detection section detecting unevenness on a surface of the recording medium by emitting detection light along the arrangement surface;

wherein at least one of the recording medium and the print head relatively moves in a parallel direction of the arrangement surface with respect to the other one, and wherein the detection section includes a sensor main body, which has a laser emitting section and a laser receiving section, and a reflective plate, which faces the sensor main body across the arrangement surface, and among the sensor main body and the reflective plate, at least the sensor main body synchronously moves with the print head and the guide portion in the separate direction.

8. The recording apparatus according to claim 7, further comprising a gap adjustment section moving the printing section with respect to the apparatus main body and adjusting a gap between a nozzle surface of the print head and the recording medium on the arrangement surface;

wherein the sensor main body is attached to a part moving with the printing section in the gap adjustment section.

9. The recording apparatus according to claim 7, wherein a spot diameter of laser light in the laser emitting section is 1 mm to 3 mm.

10. The recording apparatus according to claim 7, the sensor main body and the reflective plate face relative to each other along the guide direction.

* * * * *